US005339731A

United States Patent [19]

Howard et al.

[11] Patent Number: 5,339,731

[45] Date of Patent: Aug. 23, 1994

[54] METHOD AND APPARATUS FOR PRINTING MULTICOLORED CONTAINER BODY BLANKS IN A SINGLE PASS

[75] Inventors: William R. Howard, Holland, Pa.; Oliver J. Tysver, Flossmoor, Ill.; Sheldon Osheff, Northbrook, Ill.; John G. McGrail, River Forest, Ill.; Robert J. Petrie, Oak Lawn, Ill.

[73] Assignee: Crown Cork & Seal Company, Inc., Philadelphia, Pa.

[21] Appl. No.: 128,057

[22] Filed: Sep. 28, 1993

Related U.S. Application Data

[63] Continuation of Ser. No. 801,063, Dec. 3, 1991, abandoned.

[51] Int. Cl.[5] ..... B41F 17/08

[52] U.S. Cl. ..... 101/35; 101/37; 101/174

[58] Field of Search ..... 101/35, 36, 37, 40, 101/135, 137, 138, 174, 177, 484; 413/1, 2, 3, 70

[56] References Cited

U.S. PATENT DOCUMENTS

| | | | |
|---|---|---|---|
| 2,335,239 | 11/1943 | Gladfelter et al. | 101/137 |
| 2,369,404 | 2/1945 | Overly | 101/216 |
| 3,223,028 | 12/1965 | Brigham | 101/40 |
| 3,227,070 | 1/1966 | Brigham et al. | 101/40 |
| 3,283,739 | 11/1966 | Hinterkopf | 118/1 |
| 3,284,270 | 11/1966 | Noll et al. | 101/136 |
| 3,343,483 | 9/1967 | Schueler | 101/114 |
| 3,425,695 | 7/1969 | Anthony | 113/120 |
| 3,556,006 | 1/1971 | Papa | 101/232 |
| 3,581,257 | 5/1971 | Priessnetz | 101/389.1 |
| 3,733,709 | 5/1973 | Bassemir et al. | 34/4 |
| 3,766,851 | 10/1973 | Sirvet et al. | 101/40 |
| 3,921,847 | 11/1975 | Rentmeester | 413/1 |
| 3,960,073 | 6/1976 | Rush | 101/40 |
| 4,091,757 | 5/1978 | Urban | 413/70 |
| 4,138,941 | 2/1979 | McMillin et al. | 101/40 |
| 4,303,032 | 12/1981 | Takahashi et al. | 413/1 |
| 4,350,862 | 9/1982 | Stieger | 219/64 |
| 4,498,387 | 2/1985 | Stirbis | 101/40 |
| 4,531,929 | 7/1985 | Schwardt | 493/55 |
| 4,565,713 | 1/1986 | Schultz | 427/54.1 |
| 4,643,090 | 2/1987 | McKrell et al. | 101/218 |
| 4,739,704 | 4/1988 | Kitai | 101/415.1 |
| 4,750,420 | 6/1988 | Shriver | 101/40 |
| 4,811,663 | 3/1989 | Hefftler et al. | 101/183 |
| 4,831,930 | 5/1989 | Leanna | 101/389.1 |
| 4,838,160 | 1/1989 | Nozawa | 101/183 |
| 4,843,962 | 7/1989 | Meelman et al. | 101/240 |
| 4,854,231 | 8/1989 | Jahn | 101/77 |
| 4,854,232 | 8/1989 | Oda | 101/137 |
| 4,936,211 | 6/1990 | Pensavecchia et al. | 101/136 |
| 4,956,906 | 9/1980 | Masse et al. | 413/8 |
| 5,039,083 | 8/1991 | Senn | 271/182 |
| 5,061,140 | 10/1991 | Hamaguchi et al. | 413/6 |
| 5,088,404 | 2/1992 | MacConnell et al. | 101/246 |

FOREIGN PATENT DOCUMENTS

0412720A2 2/1991 European Pat. Off. .

(List continued on next page.)

OTHER PUBLICATIONS

Desco Equipment Corp., "Designers & Manufacturers of Decorating Systems for the Container & Closure Industries," Catalog.

(List continued on next page.)

*Primary Examiner*—Edgar S. Burr
*Assistant Examiner*—John S. Hilten
*Attorney, Agent, or Firm*—Woodcock Washburn Kurtz Mackiewicz & Norris

[57] ABSTRACT

A method and apparatus are provided for printing individual metal body blanks, from which three piece container bodies are formed, in a multi-colored image on an individual body blank basis. Individual body blanks are cut from a sheet and fed in two parallel streams to the rotating impression cylinder of a multi-color off-set litho press. The body blanks are secured to the impression cylinder using mechanical clamps and magnets and are rotated sequentially past a number of inking unit/ultraviolet lamp pairs. As each color ink is applied by an inking unit, it is immediately cured by an adjacent ultraviolet lamp before the body blank is transported to the next inking unit.

49 Claims, 10 Drawing Sheets

FOREIGN PATENT DOCUMENTS

| | | | |
|---|---|---|---|
| 2808598 | 8/1978 | Fed. Rep. of Germany . | |
| 0127154 | 7/1985 | Japan | 101/136 |
| WO90/02045 | 3/1990 | PCT Int'l Appl. . | |
| 220221 | 6/1986 | U.S.S.R. . | |
| 1161412A | 6/1986 | U.S.S.R. . | |
| 0712872 | 1/1989 | U.S.S.R. . | |
| 2111912A | 7/1983 | United Kingdom . | |

OTHER PUBLICATIONS

Taiyo North America, "The TLP-250 Narrow Web Press," Catalog.

Ko-Pack International, "Ko-Pack 250 6-Colour Label Press," Catalog.

Ko-Pack Corp. of Amer., "Ko-Pack 250 10" Narrow Web Rotary Letterpress 1 to 16 colors," Catalog.

Ko-Pack International, "Ko-Pack Model 003 Combination Press," Catalog.

Ko-Pack International, "Ko-Pack 250 Rotary Letterpress," Catalog.

Kidder-Stacy Co., "Centraflex 660 II & 886 II," Catalog.

Kidder-Stacy Co., "Accuflex the Ultimate flexographic Press," Catalog.

EPRI Center for Materials Fabrication, "TechApplication UV Curing of Coatings on Metals," vol. 1, No. 16, (1987) Catalog.

Kupfer, Flexo Printing with Future, Flexographic Printing/Machine Engineering, 4560A Papier+Kunststoff Verarbeiter International (1987) Dec., No. 2, Frankfurt.

METHOD AND APPARATUS FOR PRINTING MULTICOLORED CONTAINER BODY BLANKS IN A SINGLE PASS

This is a continuation of application Ser. No. 07/901,063, filed Dec. 3, 1991, now abandoned.

FIELD OF THE INVENTION

The current invention is directed to an apparatus for printing multi-colored decorated containers, such as aerosol cans and the like. More specifically, the current invention is directed to a high speed printing press capable of printing individual can body blanks in a variety of colors in a single pass through the press.

BACKGROUND OF THE INVENTION

Traditionally, metal containers destined for the retail market have been either "two piece" or "three piece" types. Two piece cans, which are typically aluminum, have traditionally been used as beverage containers in which strength requirements are low. Such cans are formed by joining a drawn and ironed cylindrical body to a circular lid. Two piece cans are decorated individually in their cylindrical configuration using lithographic printing presses such as that disclosed in U.S. Pat. Nos. 3,223,028 (Brigham), 3,227,070 (Brigham et al.), 3,766,851 (Sirvet et al.) and 4,138,941 (McMillin et al.). In such presses, a number of inking units are arranged around a central blanket cylinder. Each inking unit transfers the portion of the image to be printed in a single color to the blanket cylinder that then transfers the entire image to the can surface in a single pass. After printing, the cans are cured by baking in an oven. In order to prevent the colors from running together on the blanket, each color must be separated from the adjacent color by a small blank space, referred to as a "trap line."

Three piece cans have been used for many types of food stuffs and also for aerosol containers in which strength is an important requirement. Three piece cans are generally made of steel and are formed by attaching a circular top and a circular bottom to a cylindrical body portion. The body portion is formed by bending a flat rectangular plate, referred to as a body blank, into a cylinder and welding the overlapping longitudinal edges of the body blank to form a joint. The decorations for a three piece can are printed on multi-body blank sheets while still in a flat configuration.

Heretofore, it had been thought that body blanks for three piece cans could only be efficiently printed in a high speed production line by printing a substantial number of the container images in a rectangular array on a large flat metal sheet. After printing, the large sheet was cut into individual body blanks, with each body blank being used to form one can body. It was thought to be economically infeasible to separately print each can body individually in a high speed production environment.

In the traditional three piece can printing approach, the large flat sheet was printed by passing it through a two color lithographic printing press. The press employed two printing plate cylinders, each of which contained the portion of the image to be printed in a single color ink. The inks from both printing plate cylinders were applied to a common blanket cylinder that then applied the two color images to the sheet in a single pass. A number of the images to be printed were arranged side by side on the printing plates so that a row of container images was printed by each rotation of the blanket cylinder. The partially printed sheet was then baked in an oven to cure the inks.

After printing in the first two colors, the printing plates were changed to those containing the portions of the images to be printed in two different colors and the press was supplied with the new color inks. The sheet was then fed through the press in a second pass and re-baked in the oven to cure the newly applied ink. This process was repeated until all the required colors were applied to the sheet. The end result was a large sheet containing a number of can decorations in a rectangular array of rows and columns. After printing, the sheet was cut longitudinally and transversely using a slitter so as to form individual body blanks that were then formed into cylindrical container bodies. Since the inks were cured between each pass it was not necessary to form the aesthetically unappealing trap lines, required in the aforementioned two piece can printing process, to prevent the inks from running together.

Unfortunately, the traditional approach to body blank printing suffers from a variety of drawbacks. First, it is difficult to maintain uniform pressure of the blanket cylinder across such a wide sheet. As a result, the images on the body blanks cut from the center portion of the sheet are often lighter than those cut from the edge portions, causing a lack of uniformity in product appearance when the cans are displayed on a supermarket shelf.

Second, since many cans require printing in eight colors, four separate passes through the press are required. This results in considerable downtime to change the printing plates and clean up the previously used inks.

Third, since the registration of the sheet with the printing plates must be reset for each pass, the image printed in each pass may not be in precise registration with the previously printed images. This problem creates significant inefficiencies when the out-of-registration condition is discovered after the third or fourth pass since the entire sheet must then be scrapped and the process begun again from scratch.

Accordingly, it would be desirable to provide an efficient high speed method of printing body blanks in which all of the colors were applied in a single pass so that the body blanks are registered to the printing press only once. Such a method should allow for the printing of individual body blanks so that (i) uniform pressure of the blanket cylinder against the body blanks can be maintained, (ii) printing problems can be rapidly detected before unnecessary additional printing was performed, and (iii) if misprinting occurs, only the improperly printed body blanks need be scrapped.

It is known to print paper sheets in a four color printing press utilizing a central rotating impression cylinder about which a number of inking units, each containing a different color ink, are disposed - see, U.S. Pat. No. 4,936,211 (Pensavecchia). Such presses utilize a cam operated clamp to grip the sheets of paper to the impression cylinder which carries the sheet sequentially under each of the inking units. As in the case of the aforementioned press for printing body blanks, it had been though most efficient for such paper presses to print a number of document pages onto a large sheet of paper that is subsequently cut into individual pages. Hence, such paper presses do not solve the problem discussed above of a lack of uniformity in printing across the width of a wide sheet. However, such presses allow multiple colors to be printed in a single pass around the impression cylinder without the need to repeatedly re-register the sheet.

Unfortunately, paper sheet printing presses are not suitable for printing metal plates, such as container body blanks, for several reasons. First, there is no provision in such presses for curing each layer of ink before the sheet passes under the next inking unit. This presents no problem in printing paper sheets since no curing is required to prevent smearing. However, ink applied to a metal substrate must be cured prior to passing it under the next inking unit to prevent smearing and mixing of the inks. It had always been thought that this problem precluded the use of such rotary presses in a high speed metal printing operation because it is infeasible to pass the metal through a curing oven between each inking unit.

A second problem arises with respect to clamping metal body blanks to the impression cylinder. Due to their extreme flexibility, the paper sheets can be readily made to lie flat against the impression cylinder. Consequently, such presses utilize a single clamp to secure each paper sheet to the impression cylinder. Metal body blanks, however, are stiffer and can not be stably secured to the impression cylinder as readily.

Third, such presses utilize rollers to drive the paper sheets around curved guide rollers to bring the sheets into engagement with the clamps. Unfortunately, metal plates are too stiff to be directed to the impression cylinder in this manner.

Fourth, it would be difficult to incorporate more that four inking units into such presses so that the number of colors that can be applied in a single pass is limited.

Accordingly, it would be desirable to provide an efficient high speed press for separately printing individual body blanks in which all of the colors were applied in a single pass of an impression cylinder and that over came the problems of paper presses by (i) developing a method for curing the ink as the body blanks passed between inking units, (ii) developing a method of securely clamping the body blank to the impression cylinder, and (iii) developing a method of properly directing the body blanks to the impression cylinder so that they can be registered and securely clamped into position for all overlapping decorations, thereby allowing ink depositions to be accurately placed.

SUMMARY OF INVENTION

It is an object of the current invention to provide an apparatus and method for printing multicolored container body blanks in a single pass.

It is another object of the invention that the apparatus and method be capable of printing separate body blanks individually in a high speed operation.

These and other objects are accomplished in an apparatus for manufacturing printed metal body blanks adapted to be formed into containers, having (i) means for cutting a sheet of metal into a plurality of substantially flat body blanks, (ii) a printing press for printing an image on each of the body blanks, and (iii) means for transporting the body blanks from the cutting means to the printing press. The printing press has (i) a rotating impression cylinder adapted to carry each of the body blanks in a substantially circular path, (ii) a plurality of stationary inking units disposed around the periphery of the impression cylinder, whereby the impression cylinder carries the sheets under each of the inking units, and (iii) a plurality of stationary curing means disposed around the periphery of the impression cylinder, one of the curing means disposed adjacent each of the inking units, whereby the impression cylinder carries the sheets under each of the curing means. The impression cylinder has both mechanical means and magnetic means for holding each of the body blanks against its circumference.

The current invention also comprises a method of forming metal body blanks printed in a plurality of colors and suitable for being formed into container bodies, comprising the steps of (i) cutting a sheet of the metal into a plurality of the body blanks, (ii) transporting the body blanks to an impression cylinder and sequentially securing each of the body blanks thereon, (iii) applying a first color ink onto the body blanks by rotating the impression cylinder so as to carry the secured body blanks sequentially to a first inking unit, (iv) at least partially curing the first color ink applied by the first inking unit by rotating the impression cylinder so as to carry the secured body blanks sequentially from the first inking unit to a first curing means, (v) applying a second color ink onto the body blanks by rotating the impression cylinder so as to carry the secured body blanks sequentially from the first curing means to a second inking unit, (vi) at least partially curing the second color ink applied by the second inking unit by rotating the impression cylinder so as to carry the secured body blanks sequentially from the second inking unit to a second curing means, and (vii) sequentially releasing the body blanks from the impression cylinder and transporting the body blanks therefrom.

DESCRIPTION OF THE PREFERRED EMBODIMENT

Figure 1:
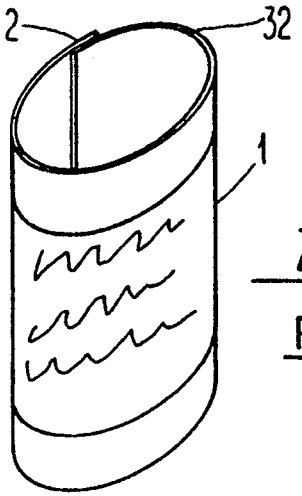
Fig. 1 PRIOR ART
FIG. 1 is an isometric view of the body blank of a three piece can after it has been printed upon and formed into a cylinder according to the prior art.

Referring to the drawings, wherein like numerals indicate like elements, there is shown in FIG. 1 a body portion 1 of a three piece can according to the prior art. As previously discussed, the body portion is made by forming a flat printed body blank 32 into a cylindrical configuration and welding the cylinder closed along the overlapping joint 2.

Figure 2:
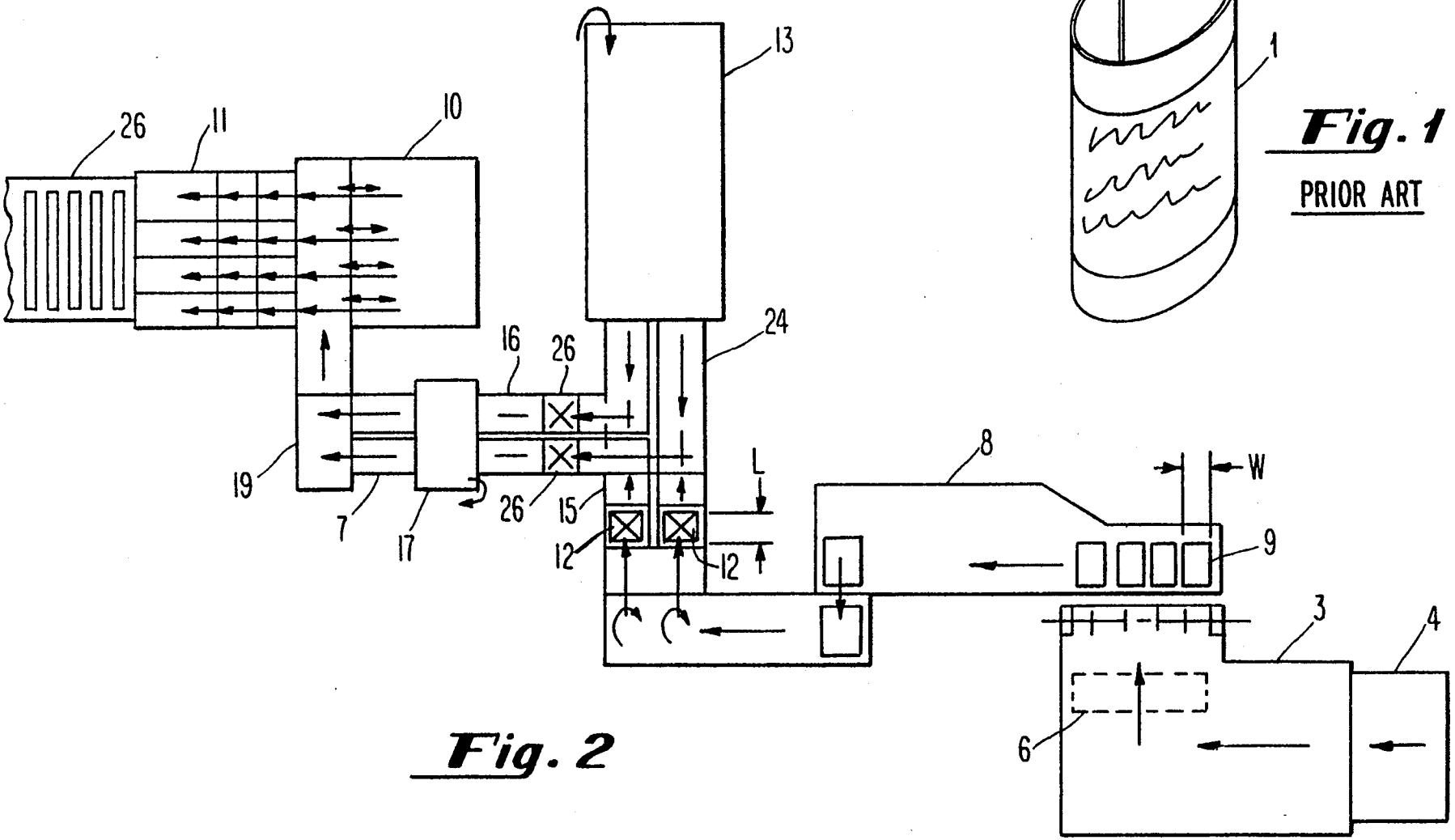
FIG. 2 is a plan view, partially schematic, of the production line for cutting and printing individual can body blanks according to the current invention.

FIG. 2 shows an overall layout of a production line according to the current invention for making the can body portion 1. A sheet 4 of a magnetic metal, such as steel, approximately 0.010 inch thick, is feed into a conventional scroll shear slitter 3. As is conventional, the sheet 4 is coated with a white base coat on its outer surface and lacquered on its inner surface prior to being fed to the slitter 3. The slitter 3 has two sets of rotating cutting heads (not shown) that first cut the sheet 4 longitudinally into intermediate strips 6 and then cut the strips transversely into individual unprinted body blanks 9—that is, into rectangular plates having a width W, corresponding to the can height, and a length L, corresponding to the can diameter. The size of the body blanks will depend on the application. Generally, the body blanks will be no more than approximately 10 inches wide by 10 inches long. Each body blank, after processing, forms a single can body 1 shown in FIG. 1.

The unprinted body blanks 9 from the slitter 3 are transported via a body blank transport unit 8, having a robot translator, that places the body blanks 9 alternately into two input hoppers 12. As is conventional, body blanks 9 are extracted from the bottom of the input hopper 12 by vacuum and deposited onto a dual lane input conveyor 15 and transported to a printing press 13, shown in FIG. 3. According to the current invention, the body blanks 9 are extracted from the input hopper 12 in pairs so that, as shown best in FIG. 4, two parallel streams of body blanks are transported by the input conveyor 15 to an impression cylinder 14 of the printing press 13, discussed further below. As shown in FIG. 2, the transport unit 8 rotates the body blanks 90° so that the edge that will ultimately form the lap joint 2, shown in FIG. 1, forms the leading edge 64 of each body blank as it is directed to the impression cylinder 14 and clamped thereon. After being carried by the impression cylinder 14 in a circular path encompassing approximately 270°, the printed body blanks 32 are unclamped and stripped by guide 25 from the impression cylinder onto a dual lane vacuum conveyor 24.

Returning to FIG. 2, the printed body blanks 32 are transported from the vacuum conveyor 24 to a dual lane conveyor 16 that is oriented 90° to the discharge conveyor 24 and that transports them to a varnishing unit 17 in which, as is conventional, a top coat of varnish is applied. After the varnish has been applied and immediately thereafter cured by ultraviolet lamps (not shown in FIG. 2), the printed body blanks 32 are transported via a conveyor 19 to a body blank stacking and transfer unit 10 that places stacks of body blanks onto a pallet 11. A take-away system 26 transports the pallets 11 to a can body maker (not shown) that forms the printed body blanks 32 into can bodies 1, shown in FIG. 1.

Figure 3:
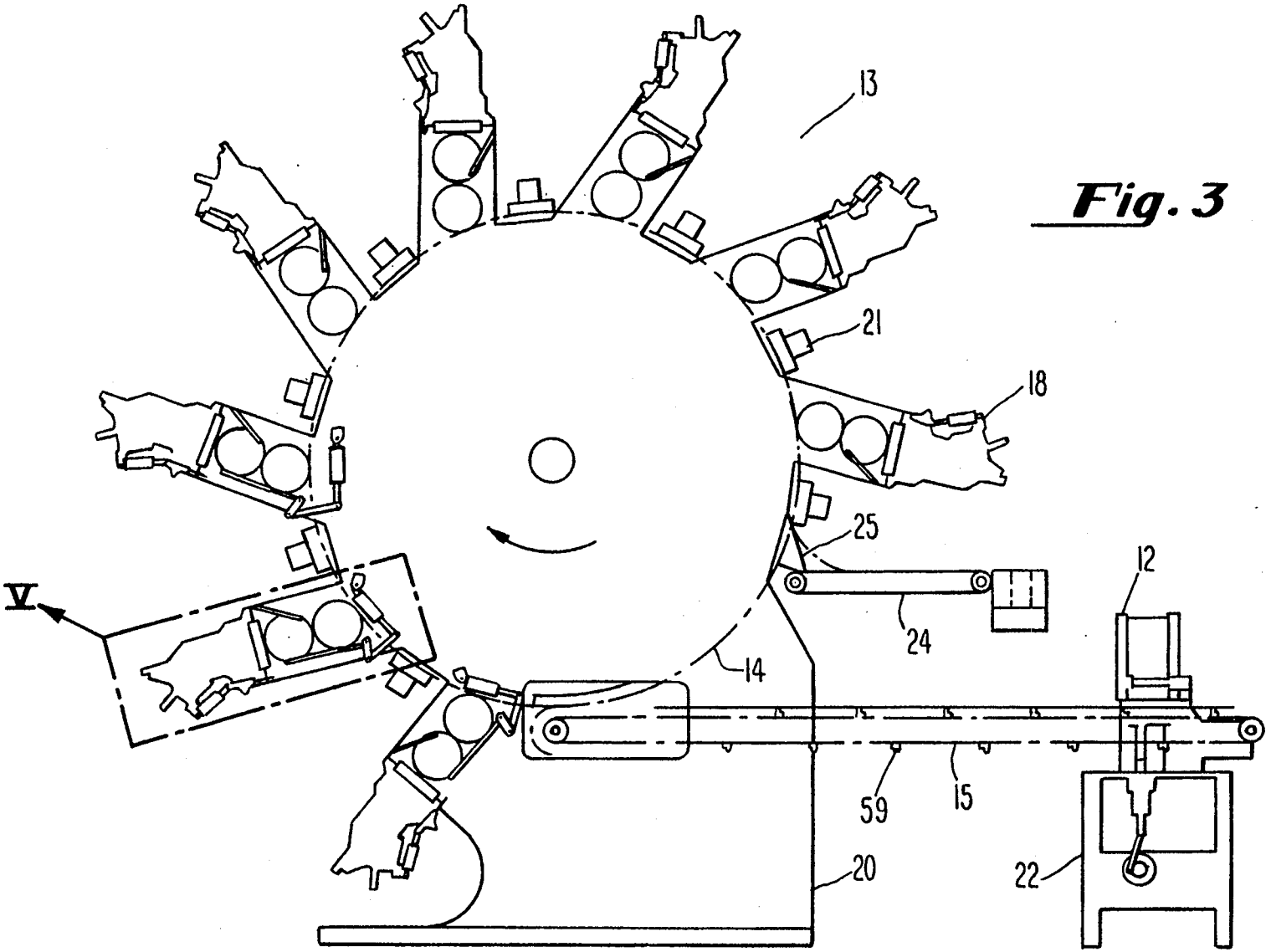
FIG. 3 is an elevation view of the printing press shown in FIG. 2.

The printing press 13 according to the current invention is shown in FIG. 3. A central impression cylinder 14 is mounted for rotation in a support frame 20 and is driven by a motor and gearing (not shown). A number of inking units 18 are supported on the frame 20 and arranged around the periphery of impression cylinder 14. One of the inking units 18 is shown in detail in FIG. 5. As is conventional, the inking unit is comprised of an ink fountain 33, an inker roll 60, a doctor roll 62, ink distribution rolls 34, oscillating rolls 62 and form rolls 63, by means of which ink from the fountain is transferred to a printing plate cylinder 35. According to an important aspect of the current invention, photosensitive ink is used in the inking units 18 so that curing can be accomplished by ultraviolet radiation. Such inks may be obtained from INX, Inc. of Elk Grove Village, Ill.

Figure 7:
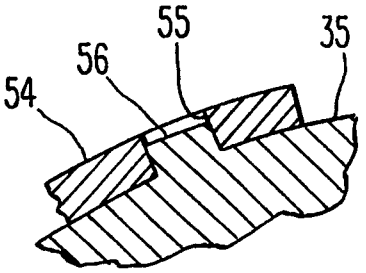
FIG. 7 is a detailed view of the portion of FIG. 6 enclosed by the circle marked VII, showing the registration pins of the printing plate on the printing plate cylinder.
Figure 6:
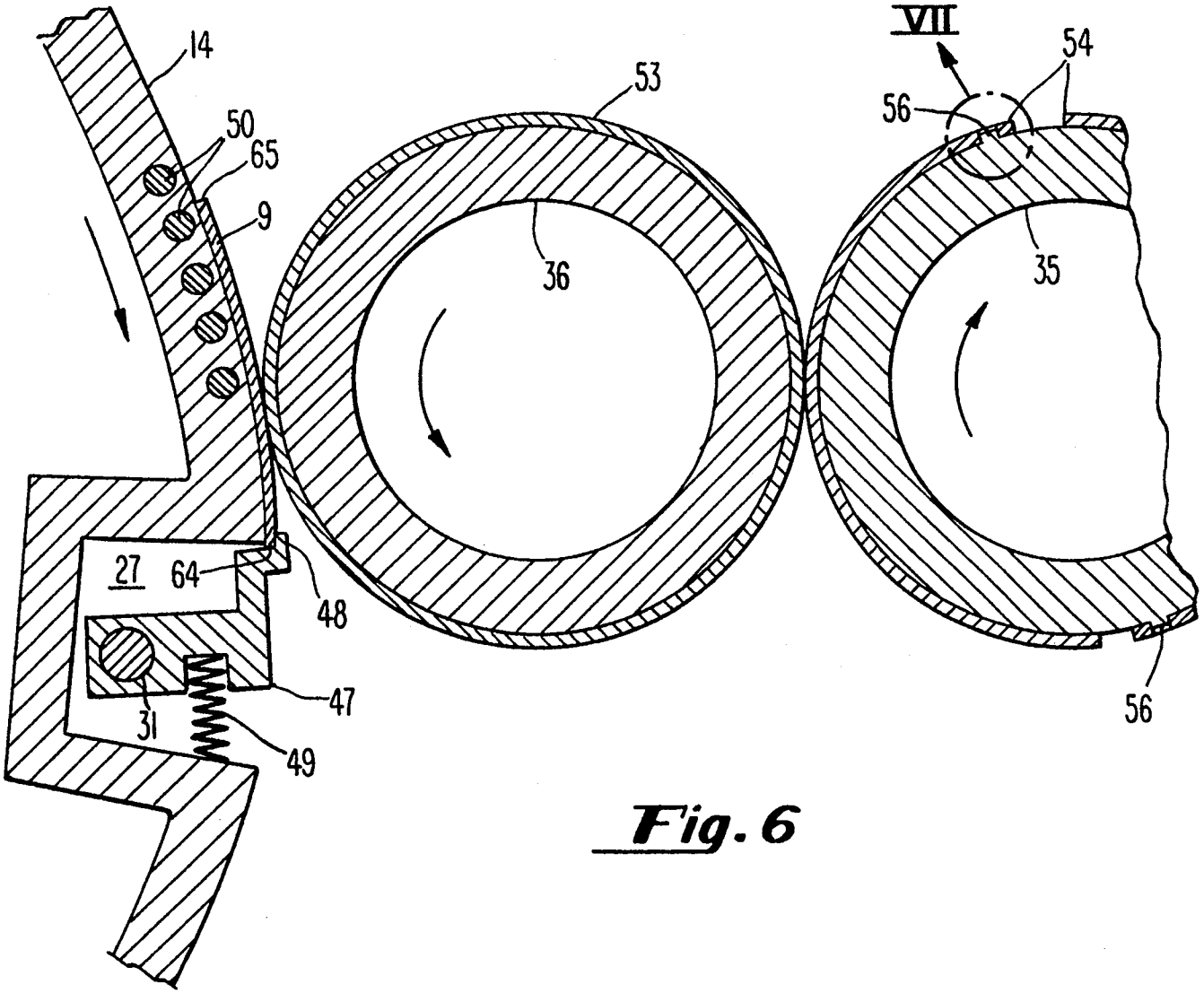
FIG. 6 is a cross-section of the printing press shown in FIG. 3 in the area where the rim of the impression cylinder meets the inking unit blanket cylinder.

As shown in FIG. 6, the printing plate cylinder 35 contains two identical conventional dry offset lithographic printing plates 54. Alternatively, water litho, letter press, gravure or flexographic printing plates can also be used. Advantageously, the plate cylinder 35 is magnetic so that the printing plates 54 are held in place by magnetic attraction, thereby simplifying plate changeover. As shown in FIG. 7, a series of pins 56 project outward from the surface of the plate cylinder 35 and are adapted to mate with close fitting holes 55 in the printing plates 54, thereby ensuring the proper registration of the plates with the cylinder. Each pair of printing plates 54 carries an image that consists of the portion of the label that is to be printed in a single color. Since, according to the current invention, the body blanks 9 are carried by the impression cylinder 14 in two parallel streams, as previously discussed, each printing plate 54 contains two identical images side by side.

Figure 5:
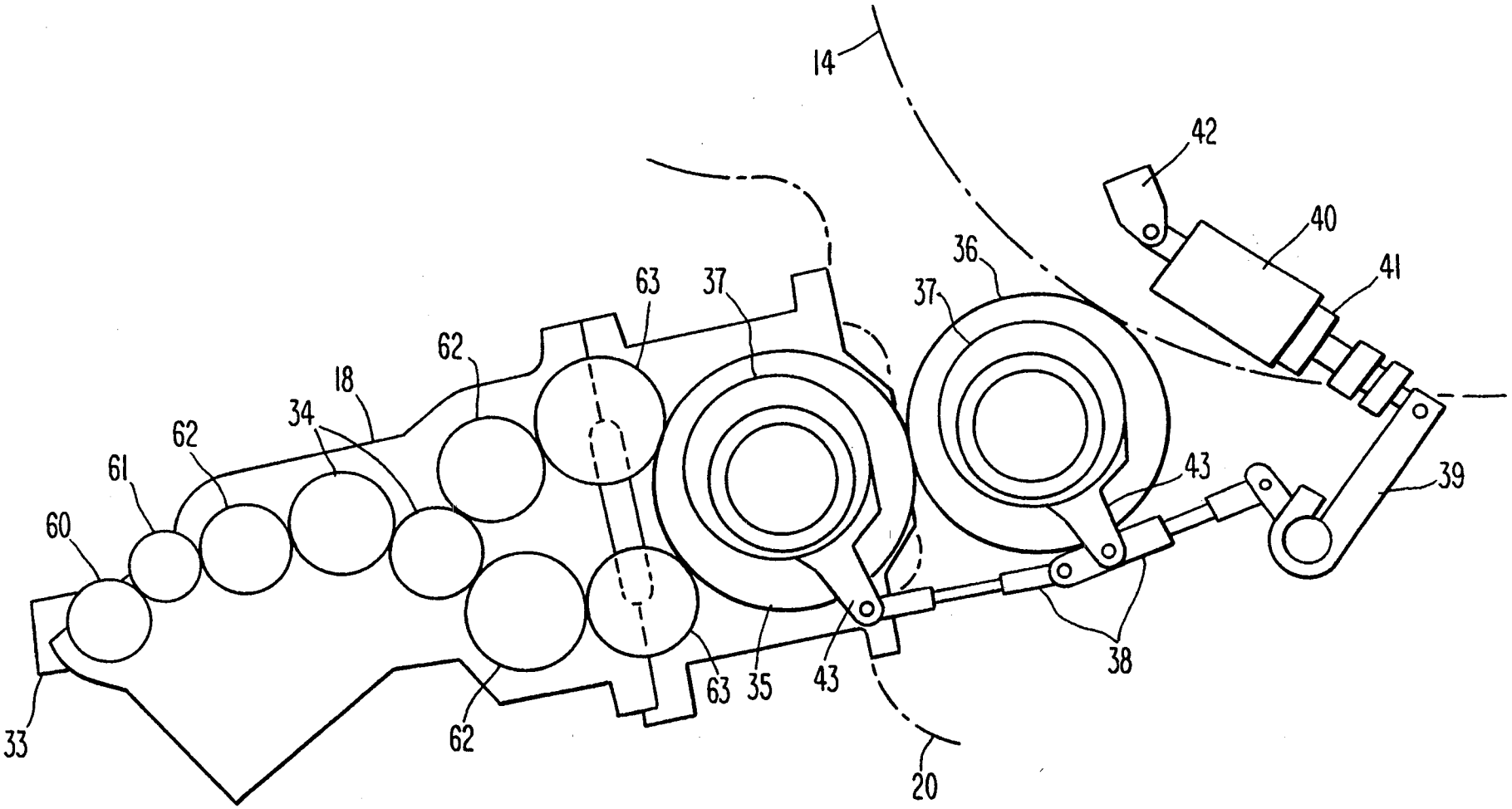
FIG. 5 is a detailed view of the portion of FIG. 3 enclosed by the oval marked V, showing an inking unit.

As shown in FIG. 5, according to the current invention, each inking unit 18 has its own blanket cylinder 36. As is conventional, each blanket cylinder 36 has mounted thereon a compliant blanket 53 adapted to transfer the ink from the printing plates 54 to the body blank 9, as shown in FIG. 6. Both the plate cylinder 35 and the blanket cylinder 36 are driven by a gear train coupled to the impression cylinder 14 gearing so that the surface speed of all three cylinders is the same, thereby ensuring proper rolling contact among the cylinders.

During operation of the press 13, it sometimes occurs that a body blank 9 is not extracted from the input hopper 12 despite efforts of the feed mechanism to the contrary. As a result, there is a gap in the stream of body blanks fed to the impression cylinder 14 that, were corrective action not taken, would result in the blanket cylinder 36 transferring ink directly to the surface of the impression cylinder. This situation is avoided by use of a conventional throw-off mechanism that allows the blanket cylinder 36 to be momentarily retracted from contact with the impression cylinder. Specifically, as shown in FIG. 5, the plate cylinder 35 and blanket cylinder 36 are supported on the frame 20 using eccentric mounts 37. Lugs 43 are attached to the eccentric mounts 37. The lugs 43 are coupled by a linkage 38 and a lever 39 to the piston 41 of a pneumatic cylinder 40 mounted on the support frame by means of a bracket 42. When a sensor (not shown) detects the absence of a body blank 9 from the input conveyor 15, it generates a signal that, at the proper time, actuates the pneumatic cylinder 40 causing the plate and blanket cylinders 35 and 36 to pivot on their eccentric mounts 37 so that the blanket cylinder is momentarily retracted from contact with the impression cylinder.

As shown in FIG. 3, in the preferred embodiment, eight inking units 18 are utilized so that eight different colors can be applied in a single pass through the printing press 13. However, the number of inking units 18 can be increased or decreased depending on the number of colors to be printed.

Figure 8:
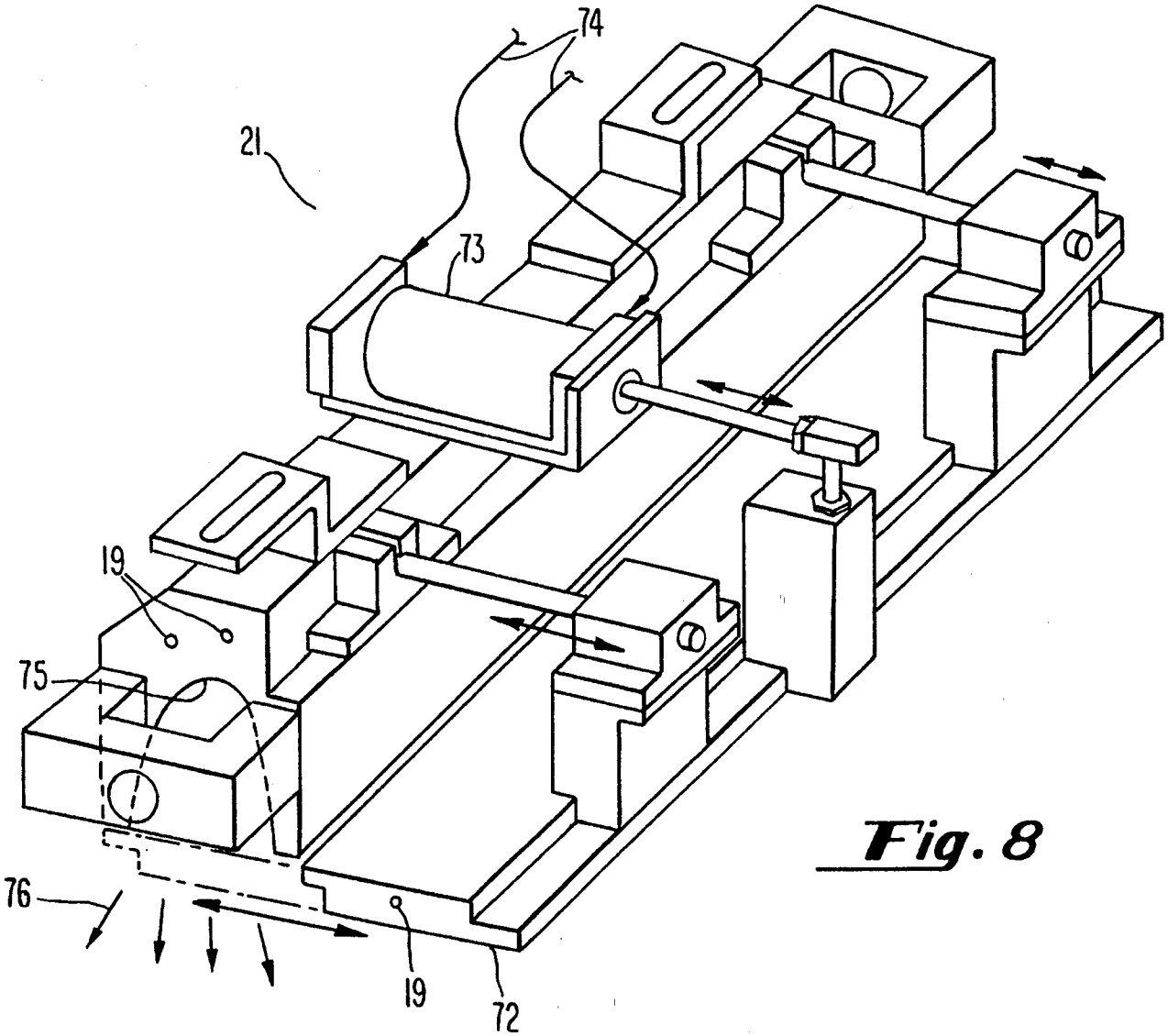
FIG. 8 is an isometric view of an ultraviolet lamp unit.

An ultraviolet lamp 21 is mounted on the support frame 20 adjacent—that is, immediately downstream—of each inking unit 18. Each ultraviolet lamp 21, shown in FIG. 8, has an arc activated tubular lamp bulb oriented transversely to the direction of travel of the body blanks 9. The lamp bulb is enclosed by a parabolic reflector 75 adapted to focus the ultraviolet radiation 76 onto the printed body blank 32 so as to rapidly cure the ink by photopolymerization. A shutter 72 is slidably mounted under the reflector 75. The shutter 72, actuated by a Bimba air cylinder 73 supplied with pressurized air 74, prevents ultraviolet radiation from reaching the impression cylinder when the press has temporarily stopped. Cooling water is supplied to the shutter 72 and lamp housing via inlet ports 19. Similarly situated outlet ports (not shown) on the opposite side of the lamp 21 discharge the water. In the preferred embodiment, the lamp 21 is approximately 20 inches long and has an output of approximately 400 watts per inch. The inventors have determined that such a lamp can adequately cure ink at body blank speeds of up to 400 feet per minute. Although FIG. 3 shows all of the ultraviolet lamps 21 mounted around the impression cylinder 14, the lamp for the last inking unit 18 could also be mounted over the output conveyor 24, rather than around the impression cylinder.

Figure 4:
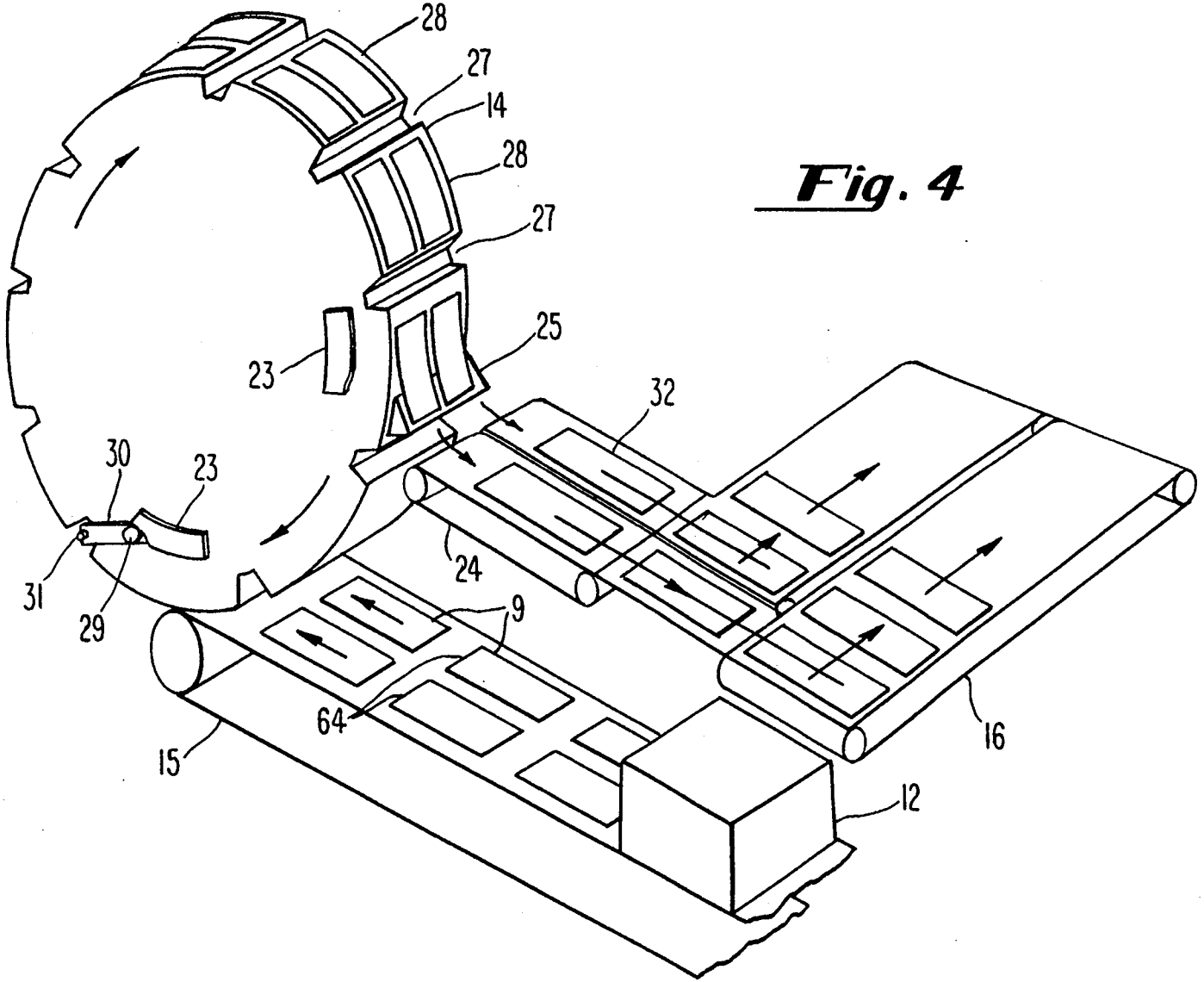
FIG. 4 is an isometric view, partially schematic, of a portion of the printing press shown in FIG. 3, including the body blank infeed and discharge conveyors.

As shown in FIG. 4, the impression cylinder 14 has a number of body blank support segments 28 equally spaced around its circumference and separated by slots 27. In the preferred embodiment, each segment 28 has sufficient length and width to carry two body blanks 9 side by side. Although the impression cylinder 14 could be made narrower or wider to accommodate a lesser or greater number of body blanks 9, it is thought that two body blanks are optimum since increasing the width of the impression cylinder 14 and the blanket cylinders 36 may lead to non-uniformity in the image produced among cans, such as plagued the approach heretofore known in the art, as previously discussed.

Figure 9:
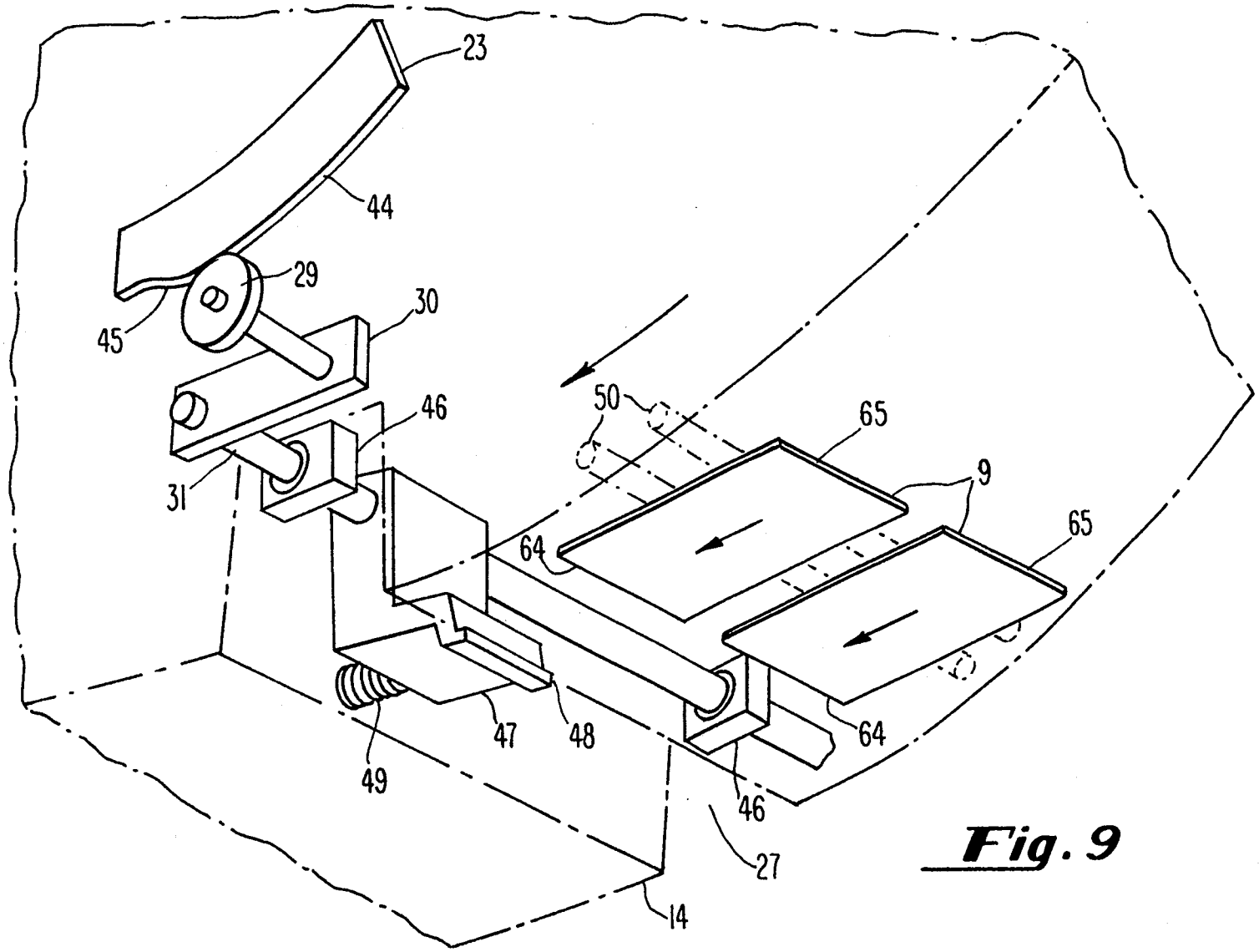
FIG. 9 is an isometric view from below of the impression cylinder shown in FIG. 4 with only one of the clamps shown.

As shown in FIG. 9, each impression cylinder slot 27 contains a conventional cam operated clamp assembly. The clamp assembly is comprised of two clamps 47 (for the sake of clarity, only one clamp is shown in FIG. 9) fixedly mounted side by side on a shaft 31 supported by sleeve bearings 46. Each clamp 47 has a jaw 48 that, when the clamp is closed, is adapted to secure the leading edge 64 of a body blank 9 against the circumference of the impression cylinder 14, as shown in FIG. 6. The clamps 47 are biased into their closed positions by a spring 49. As shown in FIG. 9, the end of the shaft 31 is coupled to a cam follower 29 by a lever 30. Radially outward displacement of the cam follower 29 causes rotation of the shaft 31 and clamp 47 that overcomes the spring 49 and opens the jaw 48 of the clamp.

As shown in FIG. 4, stationary cams 23 are mounted on the support frame 20, adjacent the impression cylinder 14, at the 3 and 6 o'clock locations. As shown in FIG. 9, the cam follower 29 travels over the cam surface 44 when the slot 27 reaches the cam locations. A rise 45 in the cam surface 44 radially displaces the cam follower 29 outward so that the jaws 48 of the clamps 47 are opened at the 3 and 6 o'clock locations, thereby facilitating the receiving and releasing of the body blanks 9 from the feed and output conveyors 15 and 16, respectively, as discussed further below. Once the slot 27 has rotated past the 3 and 6 o'clock locations, the cam followers travels past the trailing edge of the cam surface 44 and the clamp jaws 48 automatically close again under the urging of the spring 49.

As previously discussed, due to their stiffness, the metal body blanks 9 can not be securely held on the impression cylinder 14 solely by means of a clamp 47 at each of their leading edges 64. Consequently, according to the current invention, a number of tubular magnets 50 are disposed just below the surface of the impression cylinder circumference downstream of each slot 27. The magnets 50 are adapted to secure the trailing edge 65 of the body blanks 9 to the impression cylinder by magnetic force, as shown in FIG. 6.

Figure 10:
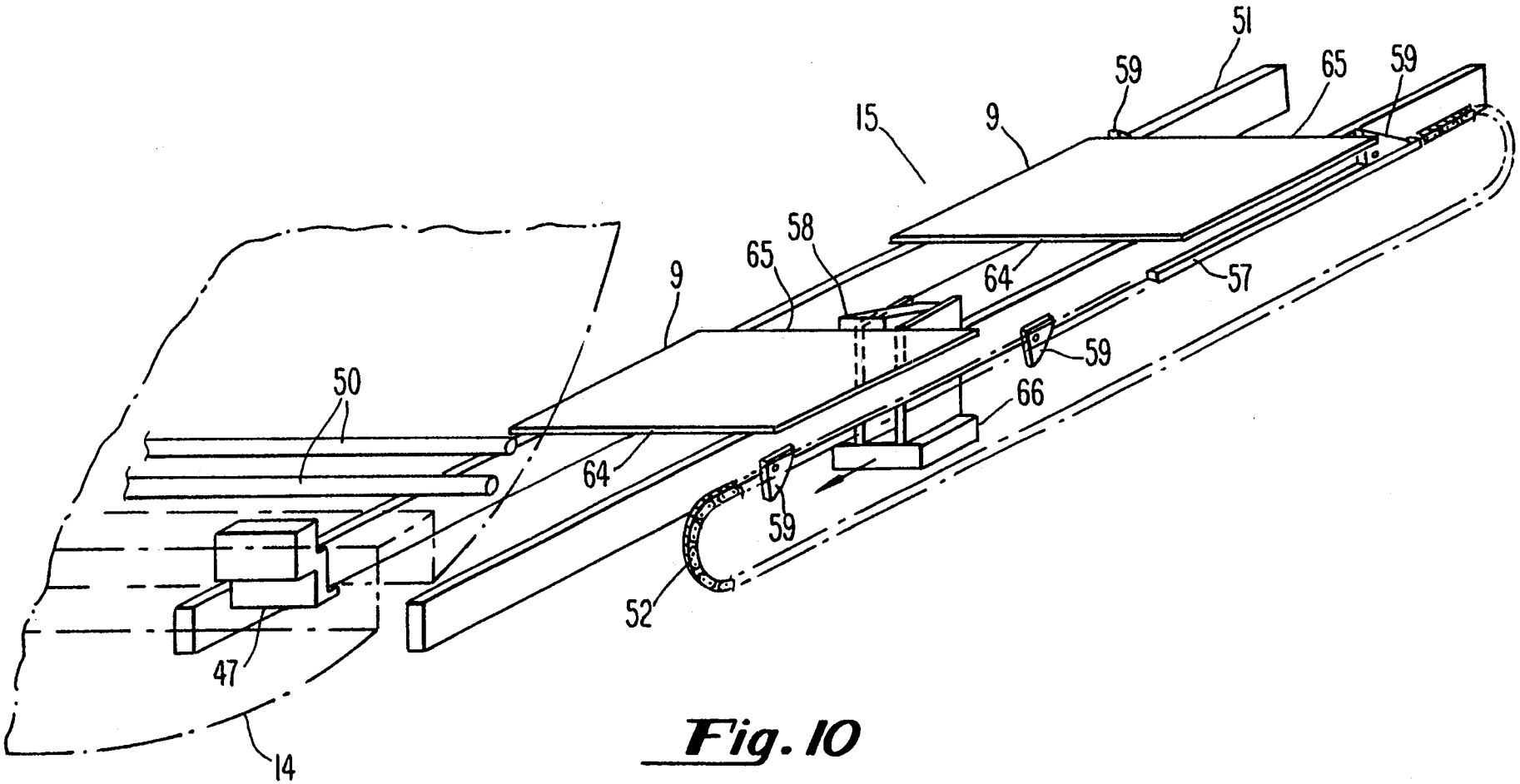
FIG. 10 is an isometric view of the body blank infeed conveyor, as well as a portion of the impression cylinder, shown in FIG. 3.
Figure 11:
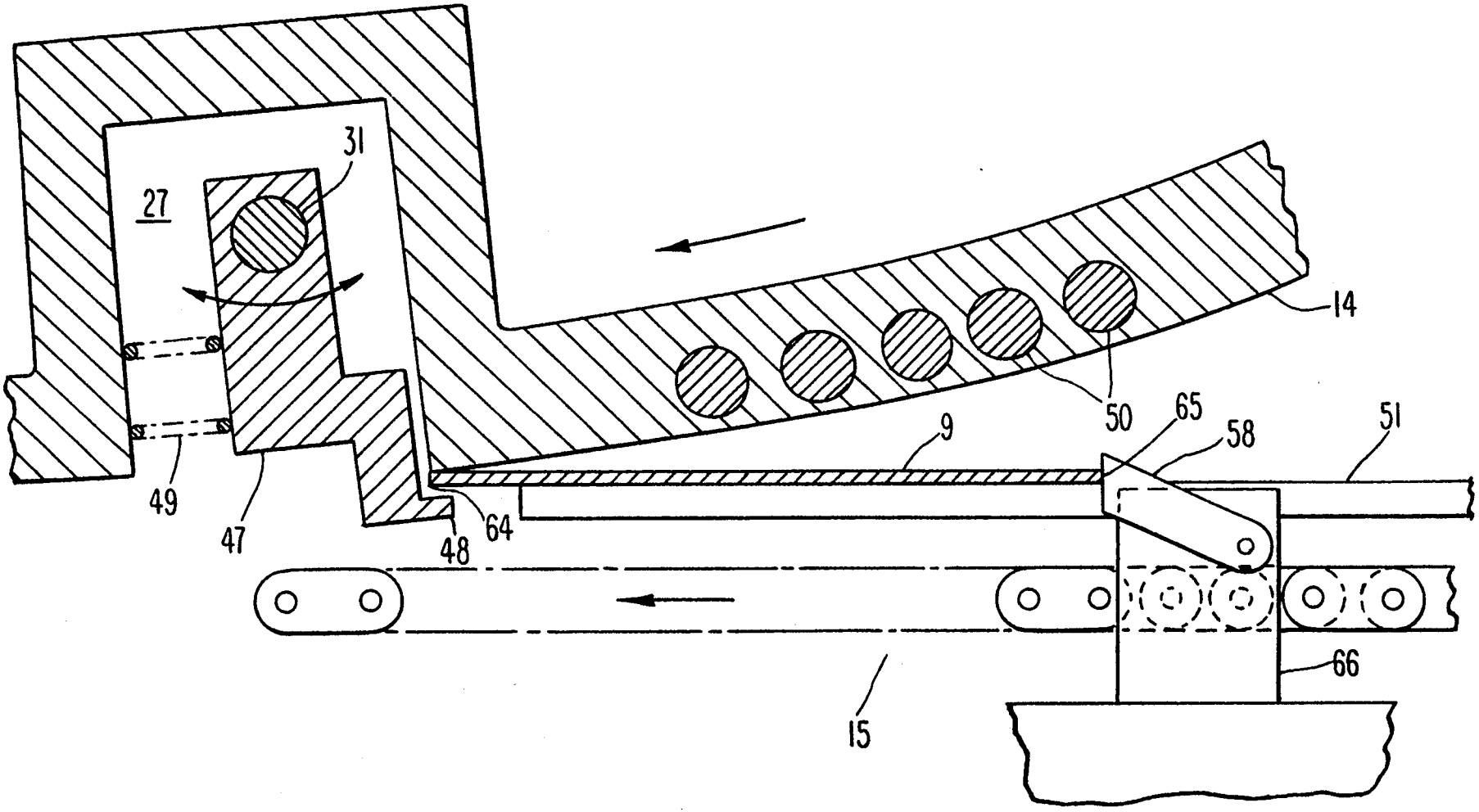
FIG. 11 is longitudinal cross-section through the infeed conveyor and the body blank clamp assembly shown in FIG. 10.

According to the current invention, two conventional feed conveyors may be adapted to transport the unprinted body blanks 9 from the input hopper 12 to the impression cylinder 14, one conveyor being used for each of the two parallel streams of body blanks 9 shown in FIG. 4. One such conveyor 15 is shown in FIGS. 10 and 11. The conveyor 15 comprises slide surfaces 51 along which the body blanks 9 slide in a path that is tangent to the circumference of the impression cylinder 14. After being extracted from the input hopper 12, the body blanks 9 are initially driven by dogs 59 that bear against the trailing edges 59 of the body blanks, as shown in FIG. 10. The dogs are driven by a chain conveyor 52 so that the speed of the body blanks move faster than the surface speed of the impression cylinder circumference. The dogs 59 are pivotally mounted and ride on a support rail 57 that maintains them in the raised position shown at the right in FIG. 10. After driving the body blank into proximity with the impression cylinder 14, the dogs 59 slide off the end of the rails 57 causing them to rotate downward so as to retract from engagement with the body blanks.

As the dogs 59 are retracting, a reciprocating registration slide 66 moves into position behind the body blank 9. As shown best in FIG. 11, a pawl 58 on the slide 66 engages the body blank trailing edge 59 and places it under the clamp jaw 48 that has been momentarily opened by the cam 23 at the 6 o'clock location, as previously discussed. The pawl 58 allows the body blank 9 to decelerate so that its speed becomes the same as that of the impression cylinder surface speed and the clamp. When the jaw 48 closes it engages the leading edge of the body blank and further rotation of the impression cylinder 14 pulls the body blank 9 around with the cylinder and brings the magnets 50 progressively closer to the body blank. When the gap between the magnets 50 and the body blank 9 is sufficiently reduced, the precise amount depending on the strength of the magnetic attraction and the weight of the body blank, the rear portion of the body blank is pulled up off of the slide surface 51 and becomes attached to the circumference of the impression cylinder 14, as shown in FIG. 6.

Continued rotation of the impression cylinder 14 carries the pair of body blanks 9 sequentially under each of the inking units 18 and ultraviolet lamps 21. Consequently, the blanket cylinder 36 of each inking unit 18 transfers an image forming the portion of the can label in a particular color ink to the body blanks, with the ink images in each color being substantially juxtaposed on images in the other colors to produce a multi-colored label. After application, each color ink image is immediately at least partially cured by exposure to ultraviolet radiation from the adjacent ultraviolet lamp 21 adjacent the inking unit 18. It is important that this curing be accomplished before the body blank 9 passes under the next inking unit 18 to ensure that there is no smearing of the image or transfer of ink between the inking units 18.

By the time the body blanks reach the 3 o'clock location, they have been carried under each inking unit 18 and ultraviolet lamp 21. At this point, the second cam 23 causes the clamps 47 to momentarily open again, thereby allowing a wedge shaped device 25 to strip the printed body blanks 32 from the impression cylinder 14 and deposit them onto a conventional vacuum conveyor 24, as shown in FIG. 4. The conveyor 24 directs the printed body blanks for further processing, as previously discussed.

In order to produce body blanks in an economical manner, the line speed should be at least 400 feet per minute. In the preferred embodiment, the impression cylinder is approximately 5 feet in diameter and rotates at approximately 25 RPM so that the linear speed of the body blanks 9 is approximately 400 feet per minute per lane. As previously discussed, the ultraviolet lamps 21 are capable of curing the ink at body blanks speeds as high as 400 feet per minute.

The aforementioned line speed of 400 feet per minute and the printing of the body blanks in two parallel streams allows approximately 800 body blanks per minute throughput to be printed by each dual lane press 13. Thus, according to the current invention, the heretofore accepted inability to print body blanks on an individual basis in a high speed operation has been overcome.

The uniformity of printing among body blanks produced by the apparatus according to the current invention is high since the short span of the printing plate and blanket cylinders 35 and 36 ensures uniform contact pressure between the cylinders and between the plate cylinder and the body blanks. In addition, since each body blank is registered to the impression cylinder only once, the accuracy of the relationship between superimposed images of different colors is limited only by the accuracy with which the registration of the various components of the press can be set up and maintained. Consequently, printing problems due to the buildup of registration tolerances after repeated registrations are eliminated. Moreover, if printing problems do occur, they can be quickly detected since only finished body blanks exit the press. Thus, the press can be immediately stopped and only the small number of body blanks already improperly printed need by scrapped. This is in contrast to the conventional approach in which an entire sheet of body blanks must be scrapped when, after several passes through the press, a misprint is detected.

Figure 12:
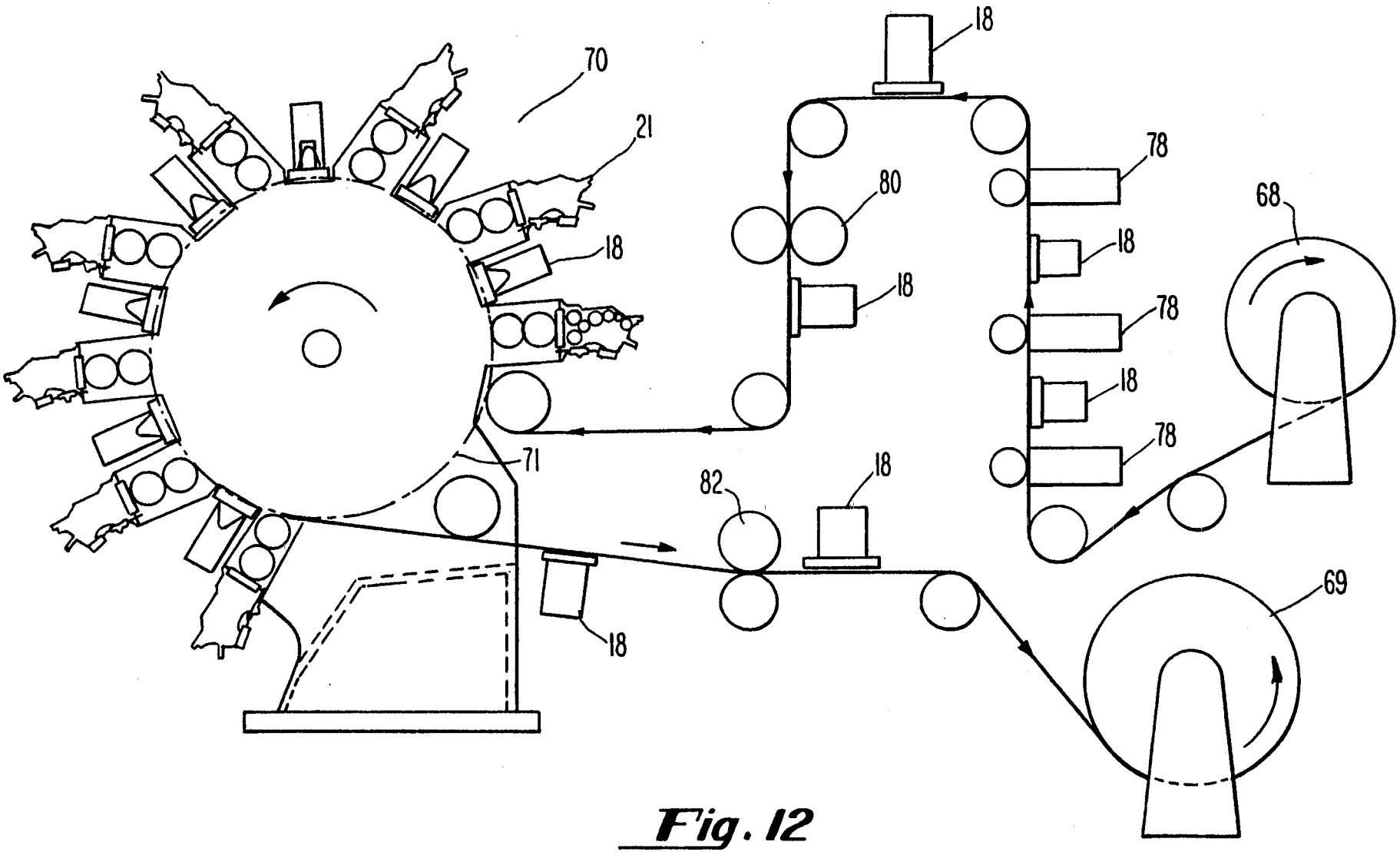
FIG. 12 is an elevation of an alternate embodiment of the apparatus according to the current invention.

FIG. 12 show an alternative embodiment of the invention using coil stock. In this embodiment, a continuous strip 67 of stock, one body blank wide, is formed and stored on an unwind coil 68. The strip 67, rather than individual body blank pieces, is transported from the unwind coil 68 to an impression cylinder 71 of a press 70. The impression cylinder 71 is similar to that discussed with respect to the embodiment shown in FIG. 3 except that there are no slots, clamps or magnets since tension in the strip 67 keeps it in contact with the circumference of the impression cylinder 71.

As the impression cylinder 71 rotates, it carries the strip 67 sequentially under inking units 18 and ultraviolet lamps 21, which may be the same as those discussed with respect to the embodiment shown in FIG. 3. Each inking unit 18 sequentially applies ink images in one color arranged longitudinally along the strip 67, with the ink images in each color being substantially juxtaposed on images in the other colors to produce a multicolored label. Each ultraviolet lamp 21 sequentially at least partially cures each color ink image immediately after it is applied and before the image is transported to the next inking unit 18, as in the previous embodiment. The printed strip is transported from the press 70 to a rewind coil 69 on which it can be stored prior to being cut transversely into individual body blanks.

As shown in FIG. 13, according to this embodiment of the current invention, three base coat inkers 78 and an inside can surface lacquer coater 80, each followed by an ultraviolet curing lamp 18, are disposed between the unwind coil 68 and the impression cylinder 71 so that raw stock can be stored on the unwind coil 68. Moreover, an outside can surface varnish coater 82, followed by another ultraviolet curing lamp 18, is disposed between the impression cylinder 71 and the rewind coil 69 so that the finished strip 68 can be fed directly from the rewind coil 69 to a slitter to form individual body blanks.

As can be appreciated, synchronizing of the base coaters 78, lacquer coater 80, inking units 18 and varnish coater 82 is vitally important to prevent wastage of metal when utilizing the embodiment shown in FIG. 13. In the past, such synchronizing was accomplished with gearing. Unfortunately, this approach suffers from the drawback that only a limited number of gear ratios are available, whereas the printing press 70 must be capable of printing body blanks in a wide variety of lengths to provide for various can diameters—that is, the press must be capable of being synchronized in a wide range of repeat lengths. According to the current invention, this synchronization is advantageously accomplished using a servo drive system.

Although the current invention has been discussed with reference to body blanks that each form only one can, it should be understood that longer or wider body blanks could also be used such that two or more cans could be printed onto each body blank and the body blanks cut again into individual can sizes after printing. Moreover, the invention can be practiced using a wet, as well as a dry, offset lithographic process, or the invention could be practiced using a letter press, gravure or flexograhic process. Thus, the present invention may be embodied in other specific forms without departing from the spirit or essential attributes thereof and, accordingly, reference should be made to the appended claims, rather than to the foregoing specification, as indicating the scope of the invention.

What is claimed:

1. A method of forming metal body blanks printed in a plurality of colors and suitable for being formed into container bodies, comprising the steps in the following sequence of:

a) a cutting a sheet of said metal into a plurality of said body blanks;

b) transporting said body blanks to an impression cylinder and sequentially securing each of said body blanks thereon with a magnet so that a plurality of body blanks are simultaneously secured to said impression cylinder;

c) applying a first color ink onto said body blanks by rotating said impression cylinder so as to carry said secured body blanks sequentially past a first inking unit;

d) at least partially curing said first color ink applied by said first inking unit by rotating said impression cylinder so as to carry said secured body blanks sequentially past a first curing device;

e) applying a second color ink onto said body blanks by rotating said impression cylinder so as to carry said secured body blanks sequentially from said first curing device to a second inking unit;

f) at least partially curing said second color ink applied by said inking unit by rotating said impression cylinder so as to carry said secured body blanks sequentially past a second curing device; and g) sequentially releasing said body blanks from said impression cylinder and transporting said body blanks therefrom.

2. The method according to claim 1, wherein the step of securing said body blanks to said impression cylinder comprises the step of attracting said body blanks to said impression cylinder by magnetic force.

3. The method according to claim 2, wherein said magnetic force is created by a plurality of said magnets disposed in said impression cylinder.

4. The method according to claim 2, wherein the step of securing said body blanks to said impression cylinder further comprises the step of clamping an edge of each of said blanks to the circumference of said impression cylinder.

5. The method according to claim 1, wherein said first and second curing devices each comprise an ultraviolet lamp.

6. The method according to claim 5, wherein the steps of at least partially curing said first and second color inks comprises the steps of rotating said impression cylinder so as to carry said body blanks under said ultraviolet lamps at a speed of at least approximately 400 feet per minute.

7. The method according to claim 1, further comprising the step of rotating said impression cylinder so as to carry said secured body blanks sequentially from said second curing device to third, fourth, fifth, sixth, seventh and eighth inking units and curing devices prior to the step of releasing said body blanks.

8. The method according to claim 1, wherein each of said body blanks is adapted to be formed into only one container.

9. The method according to claim 8, further comprising the step of forming said body blanks into cylindrical container bodies after the step of transporting said body blanks away from said impression cylinder.

10. The method according to claim 1, wherein the steps of transporting said body blanks to said impression cylinder and carrying said body blanks therearound comprise the steps of transporting and carrying said body blanks in at least two substantially parallel streams.

11. The method according to claim 1, wherein the step of cutting said sheet of metal into body blanks comprises the step of cutting said sheet into approximately rectangular pieces no more than approximately 10 inches wide by 10 inches long.

12. An apparatus for manufacturing printed metal plates adapted to be formed into containers, comprising:

a) a cutter having means for cutting a sheet of metal into a plurality of substantially flat plates such that each of said flat plates is suitable for forming a single container body; and b) a printing press for printing an image on each of said plates, said printing press having:

(i) a rotating impression cylinder having a plurality of segments, each of said segments having means for receiving at least one of said plates from said cutter and for carrying said plate received in a substantially circular path, the means for receiving and carrying including magnetic means for holding each of said plates;

(ii) a plurality of stationary inking units disposed around the periphery of said impression cylinder, whereby said impression cylinder carries said sheets under each of said inking units, each of said inking units having means for applying an ink image to said plates;

(iii) a plurality of curing devices each having means for curing said ink applied by said inking units disposed around the periphery of said impression cylinder, one of said curing devices disposed adjacent each of said inking units, whereby said impression cylinder carries said plates under each of said curing devices.

13. The apparatus according to claim 12, wherein each of said curing devices comprises an ultraviolet lamp.

14. The apparatus according to claim 12, wherein said impression cylinder has both mechanical devices and said magnetic means for holding each of said plates against the circumference of said impression cylinder.

15. The apparatus according to claim 14, further comprising means for transporting said plates from said cutter to said printing press.

16. The apparatus according to claim 15, wherein:

a) each of said plates has a leading edge, and wherein said transporting means has means for delivering said leading edges of said plates to said impression cylinder;

b) said mechanical holding means comprises a plurality of clamping means for clamping said leading edges of said plates to said circumference of said impression cylinder; and c) said magnetic holding means comprises a magnet disposed below said circumference of said impression cylinder.

17. The apparatus according to claim 12, further comprising a clamp for each of said segments, and wherein each of said clamps is capable of assuming closed and opened positions, each of said clamps biased to be normally closed and actuated into said open position by a first cam.

18. The apparatus according to claim 17, wherein said first cam has a cam surface and is disposed adjacent said impression cylinder, and wherein each of said clamps comprises a cam follower adapted to urge said clamp into said open position when following said cam surface.

19. The apparatus according to claim 18, further comprising:

a) means for feeding said plates into said clamps at a first circumferential location around said printing press, and b) a remover having means for removing said plates from said segments at a second circumferential location around said printing press.

20. The apparatus according to claim 19, wherein said first cam has means for opening each of said clamps when said clamp reaches said first location, and further comprising a second cam having means for opening each of said clamps when said clamps reach a second circumferential location.

21. The apparatus according to claim 19, wherein said remover comprises a wedge adapted to be interposed between said segments and said plates.

22. The apparatus according to claim 12, wherein said cutter comprises a slitter having means for cutting said sheet both longitudinally and transversely.

23. The apparatus according to claim 12, further comprising a conveyor for transporting said plates from said cutter to said printing press.

24. The apparatus according to claim 23, wherein said conveyor has means for transporting said plates to said impression cylinder in a plurality of parallel streams, and wherein said impression cylinder has means for carrying one of said sheets from each of said streams side by side along said circular path, whereby a plurality of said sheets pass simultaneously under each of said inking units and each of said curing devices.

25. The apparatus according to claim 23, further comprising:

a) an additional inking unit disposed around the periphery of said impression cylinder adapted to apply the last ink image to be applied to said plates; and b) an additional curing device disposed over said conveyor for curing ink applied by said additional inking unit.

26. The apparatus according to claim 12, wherein each of said inking units has means for transferring an image onto said plates using a lithographic ink.

27. The apparatus according to claim 26, wherein each of said inking units comprises:

a) a fountain adapted to contain a lithographic ink;

b) a first cylinder on which at least one printing plate is mounted;

c) an ink distribution roll for transferring ink from said ink fountain to said printing plate; and d) a second cylinder on which is mounted a compliant blanket.

28. A printing press for printing an image onto metal container body blanks prior to forming said body blanks into cylinders, said image formed from a plurality of colors, comprising:

a) a support stand;

b) a plurality of inking units arranged circumferentially around said support stand, each of said inking units having means for applying to said metal body blanks the portion of said image to be printed in a particular color using an ultraviolet curable ink;

c) an ultraviolet lamp for each of said inking units arranged circumferentially around said support stand, each of said lamps disposed adjacent each of said inking units;

d) an impression cylinder rotatably mounted in said support stand and having both mechanical and magnetic means for simultaneously holding a plurality said body blanks onto its circumference, said impression cylinder having means for carrying said body blanks in a circular path sequentially past each of said inking units and said lamps, whereby said portion of said image applied to said body blank in each one of said colors is at least partially cured prior to applying said portion of said image to said body blank in another one of said colors.

29. The printing press according to claim 28, wherein each of said body blanks has an edge, and further comprising a conveyor for delivering said body blanks to said impression cylinder along a path, whereby said edge forms a leading edge of said body blank.

30. The printing press according to claim 29, wherein said impression cylinder has a plurality of transversely oriented slots uniformly distributed around its circumference, a clamp having opened and closed positions disposed within each of said slots, each of said clamps having a jaw means for engaging said leading edges of said body blanks and for holding said leading edges against the circumference of said impression cylinder when said clamp is in said closed position.

31. The printing press according to claim 30, further comprising a spring for each of said clamps for biasing its respective clamp into said closed position, whereby force is required to place said clamp in said opened position.

32. The printing press according to claim 31, further comprising:

a) a cam follower coupled to each of said clamps, each of said cam followers adapted to apply a force that over comes said spring force so as to place its respective clamp in said open position when said cam follower is displaced; and b) a cam having a cam surface and mounted on said support frame, said cam located on said support frame so that said cam surface displaces said cam follower when its respective clamp rotates into a position that is proximate with said path along which said conveyor delivers said body blanks to said impression cylinder.

33. The printing press according to claim 32 wherein said path along which said conveyor delivers said body blanks to said impression cylinder is substantially tangent to the circumference of said impression cylinder.

34. The printing press according to claim 28, wherein each of said body blanks has leading and trailing edges, and further comprising:

a) a plurality of clamps circumferentially arranged around the circumference of said impression cylinder, each of said clamps having means for securing said leading edge of each of said body blanks to said impression cylinder; and b) an input conveyor having:

(i) a slide surface having means for carrying said body blanks along a path toward said impression cylinder, (ii) a first driver having means for driving said body blanks along said slide surface toward said impression cylinder at a first speed into engagement with said clamps when said clamps are in a predetermined circumferential location, and (iii) a second driver having means for driving said body blanks along said slide surface toward said impression cylinder at a second speed into engagement with said first driver.

35. The printing press according to claim 34, wherein said first speed is approximately equal to the speed of the circumference of said impression cylinder and said second speed is greater than said first speed.

36. The printing press according to claim 34, wherein each of said clamps is opened by a cam when each of said clamps is in said predetermined position.

37. The printing press according to claim 34, wherein said second driver comprises a chain conveyor having means for engaging said trailing edge of each of said body blanks.

38. The printing press according to claim 37, wherein said engaging device comprises a dog.

39. The printing press according to claim 37, wherein said first driver has a pawl for engaging said trailing edge of each of said body blanks.

40. The printing press according to claim 34, wherein said slide surface is oriented substantially tangent to the circumference of said impression cylinder.

41. The printing press according to claim 34, wherein said impression cylinder has a magnet mounted therein downstream of each of said clamps, and wherein said slide surface is oriented so that rotation of said impression cylinder after one of said clamps has engaged one of said body blanks brings said magnet downstream of said clamp progressively closer to said body blank.

42. A printing press for printing an image onto metal container body blanks prior to forming said body blanks into cylinders, said image formed from a plurality of colors, comprising:

a) a support stand;

b) a plurality of inking units arranged circumferentially around said support stand, each of said inking units adapted to apply to said metal body blanks the portion of said image to be printed in a particular color;

c) an impression cylinder rotatably mounted in said support stand and having means for carrying said plates in a circular path sequentially past each of said inking units;

d) a plurality of clamps circumferentially arranged around the circumference of said impression cylinder, each of said clamps having means for securing a first portion of each of said body blanks to said impression cylinder; and e) a magnet assembly having means for securing a second portion of each of said body blanks to said impression cylinder.

43. The printing press according to claim 42, further comprising an ultraviolet lamp for each of said inking units arranged circumferentially around said support stand, each of said lamps disposed adjacent each of said inking units, said impression cylinder adapted to carry said plates in a circular path sequentially past each of said lamps, whereby said portion of said image applied to said body blank in each one of said colors is cured prior to applying said portion of said image to said body blank in another one of said colors.

44. The printing press according to claim 42, wherein said magnet assembly comprises a first magnet for each of said clamps, each of said first magnets mounted in said impression cylinder circumferentially downstream of its respective clamp.

45. The printing press according to claim 44, wherein each of said body blanks has leading and trailing edges, said first and second portions of each of said body blanks comprising said leading and trailing edges, respectively.

46. The printing press according to claim 44, wherein each of said first magnets is disposed radially inboard of the circumference of said impression cylinder.

47. The printing press according to claim 46, wherein each of said first magnets extends substantially across the width of said impression cylinder.

48. The printing press according to claim 44, wherein said magnet assembly further comprising a second magnet for each of said clamps, each of said second magnets mounted in said impression cylinder circumferentially downstream of each of said first magnets.

49. An apparatus for manufacturing printed metal plates adapted to be formed into containers, comprising:

a) cutting means for cutting a sheet of metal into a plurality of substantially flat plates such that each of said flat plates has a length and width of less than approximately 10 inches by 10 inches, respectively and b) printing press means for printing an image on each of said plates, said printing press means having:

(i) a rotating impression cylinder having a plurality of segments, each of said segments having means for receiving at least one of said plates from said cutting means and for securing said plate received to said impression cylinder and for carrying said plates in a substantially circular path, said means for receiving and securing including a securing magnet;

(ii) a plurality of stationary inking units disposed around the periphery of said impression cylinder, whereby said impression cylinder carries said sheets under each of said inking units, each of said inking units having means for applying an ink image to said plates;

(iii) a plurality of curing means for curing said ink applied by said inking units disposed around the periphery of said impression cylinder, one of said curing devices disposed adjacent each of said inking units, whereby said impression cylinder carries said plates under each of said curing devices.

* * * * *

UNITED STATES PATENT AND TRADEMARK OFFICE

CERTIFICATE OF CORRECTION

PATENT NO. : 5,339,731

DATED : August 23, 1994

INVENTOR(S) : Howard et al.

It is certified that error appears in the above-identified patent and that said Letters Patent is hereby corrected as shown below:

Column 1, line 7, please delete "07/901,063" and insert therefor --07/801,063--;
Column 15, line 41, please delete "adapted to carry" and insert therefor --having means for carrying--.

Signed and Sealed this

Twenty-seventh Day of December, 1994

*Attest:*

Bruce Lehman

BRUCE LEHMAN

*Attesting Officer*

*Commissioner of Patents and Trademarks*